US011692301B2

(12) United States Patent
Mashal et al.

(10) Patent No.: US 11,692,301 B2
(45) Date of Patent: Jul. 4, 2023

(54) SYSTEM AND METHOD FOR USING SOUND TO MONITOR THE OPERATION OF A DRYER APPLIANCE

(71) Applicant: Haier US Appliance Solutions, Inc., Wilmington, DE (US)

(72) Inventors: Khalid Jamal Mashal, Louisville, KY (US); Nemetalla Salameh, Louisville, KY (US); Juan Manuel Huerta, Louisvile, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 318 days.

(21) Appl. No.: 17/072,661

(22) Filed: Oct. 16, 2020

(65) Prior Publication Data

US 2022/0120026 A1 Apr. 21, 2022

(51) Int. Cl.

| | |
|---|---|
| ***D06F 58/52*** | (2020.01) |
| ***D06F 34/18*** | (2020.01) |
| ***D06F 34/04*** | (2020.01) |
| ***D06F 103/04*** | (2020.01) |
| ***D06F 105/58*** | (2020.01) |
| ***D06F 105/62*** | (2020.01) |
| ***D06F 103/06*** | (2020.01) |
| ***D06F 103/26*** | (2020.01) |

(Continued)

(52) U.S. Cl.

CPC ..... *D06F 58/52* (2020.02); *D06F 34/04* (2020.02); *D06F 34/18* (2020.02); *D06F 2103/04* (2020.02); *D06F 2103/06* (2020.02); *D06F 2103/08* (2020.02); *D06F 2103/26* (2020.02); *D06F 2103/36* (2020.02); *D06F 2105/58* (2020.02); *D06F 2105/62* (2020.02)

(58) Field of Classification Search

CPC ..... D06F 58/52; D06F 34/04; D06F 34/18; D06F 2105/62; D06F 2105/58; D06F 2103/08; D06F 2103/26; D06F 2103/04; D06F 2103/06

USPC ..... 34/89, 595–610

See application file for complete search history.

(56) References Cited

U.S. PATENT DOCUMENTS 5,272,892 A * 12/1993 Janutka ..... D06F 39/087 68/12.22
5,755,118 A * 5/1998 Woo ..... D06F 39/087 68/12.27

(Continued)

FOREIGN PATENT DOCUMENTS

CN 109479019 A 3/2019
DE 102008013557 A1 * 9/2009 ..... D06F 37/203

(Continued)

*Primary Examiner* — Stephen M Gravini
(74) *Attorney, Agent, or Firm* — Dority & Manning, P.A.

(57) ABSTRACT

A dryer appliance includes a microphone for monitoring sound generated during operation of the dryer appliance and a controller is operably coupled to the microphone. The controller is configured for obtaining a sound signal generated during operation of the dryer appliance and converting the sound signal into a spectrogram that represents a sound frequency and a sound amplitude over time. An artificial intelligence image recognition process is used to analyze the spectrogram to identify one or more sound signatures that are associated with particular operating conditions, and operation of the dryer appliance is adjusted based at least in part on the identification of the sound signature.

20 Claims, 5 Drawing Sheets

(51) Int. Cl.
*D06F 103/36* (2020.01)
*D06F 103/08* (2020.01)

(56) References Cited

U.S. PATENT DOCUMENTS

| | | | | |
|---|---|---|---|---|
| 6,742,208 | B2 * | 6/2004 | Broker | D06F 33/48 8/158 |
| 2003/0037382 | A1 * | 2/2003 | Broker | D06F 33/48 68/12.02 |
| 2011/0000100 | A1 | 1/2011 | Malcher | |
| 2016/0258104 | A1 * | 9/2016 | James | G05B 19/042 |
| 2021/0277564 | A1 * | 9/2021 | Mashal | D06F 33/44 |
| 2021/0355621 | A1 * | 11/2021 | Parhar | H05B 6/668 |
| 2022/0120026 | A1 * | 4/2022 | Mashal | D06F 34/18 |
| 2022/0349102 | A1 * | 11/2022 | Yun | G06N 3/08 |

FOREIGN PATENT DOCUMENTS

| | | | | |
|---|---|---|---|---|
| EP | 2255033 | B1 * | 6/2011 | D06F 37/203 |
| JP | 2007167175 | A | 7/2007 | |
| JP | 2019150362 | A | 9/2019 | |
| KR | 2019108532 | A | 9/2019 | |
| WO | WO-2021175336 | A1 * | 9/2021 | D06F 33/34 |

* cited by examiner

SYSTEM AND METHOD FOR USING SOUND TO MONITOR THE OPERATION OF A DRYER APPLIANCE

FIELD OF THE INVENTION

The present subject matter relates generally to dryer appliances, or more specifically, to systems and methods for monitoring sounds within a dryer appliance and analyzing those sounds to identify sound signatures associated with particular events.

BACKGROUND OF THE INVENTION

Dryer appliances generally include a cabinet with a drum rotatably mounted therein. During operation, a motor rotates the drum, e.g., to tumble articles located within a chamber defined by the drum. Dryer appliances also generally include a heater assembly that passes heated air through the chamber in order to dry moisture-laden articles positioned therein. Typically, an air handler or blower is used to urge the flow of heated air from chamber, through a trap duct, and to the exhaust duct where it is exhausted from the dryer appliance.

Notably, it is frequently desirable to monitor sounds generated by a dryer appliance during operation, e.g., to identify unintended objects in a load of clothes, to estimate a dryness level of the load of clothes, to diagnose mechanical failures, or to detect other operating conditions. However, conventional dryer appliances lack any sound feedback systems. Certain dryer appliances may monitor sounds and provide a notification when a sound exceeds a certain threshold, but such systems have limited usefulness and effectiveness.

Accordingly, a dryer appliance with features for improved operation would be desirable. More specifically, a system and method for monitoring sounds generated by a dryer appliance and identifying sound signatures associated with particular operating conditions would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a dryer appliance is provided, including a cabinet, a drum rotatably mounted within the cabinet, the drum defining a chamber for receipt of clothes for drying, and a microphone for monitoring sound generated during operation of the dryer appliance. A controller is operably coupled to the microphone and is configured to obtain a sound signal generated during operation of the dryer appliance using the microphone, generate a spectrogram from the sound signal, the spectrogram representing a sound frequency and a sound amplitude over time, identify a sound signature by analyzing the spectrogram using an image recognition process, and adjust at least one operating parameter of the dryer appliance based at least in part on the identification of the sound signature.

In another exemplary embodiment, a method of operating a dryer appliance is provided. The dryer appliance includes a drum rotatably mounted within a cabinet, the drum defining a chamber for receipt of clothes for drying, and a microphone for monitoring sound generated during operation of the dryer appliance. The method includes obtaining a sound signal generated during operation of the dryer appliance using the microphone, generating a spectrogram from the sound signal, the spectrogram representing a sound frequency and a sound amplitude over time, identifying a sound signature by analyzing the spectrogram using an image recognition process, and adjusting at least one operating parameter of the dryer appliance based at least in part on the identification of the sound signature.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
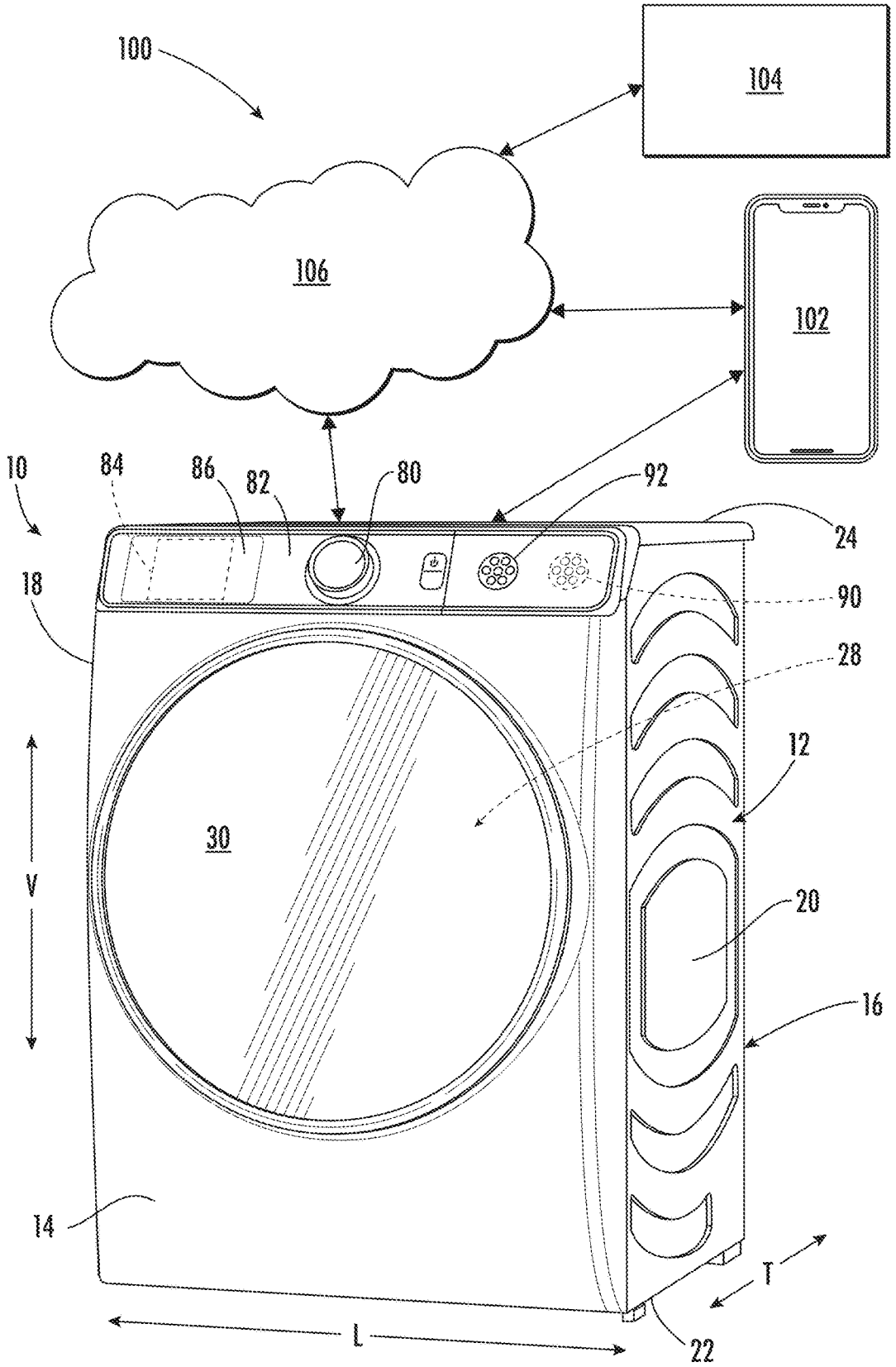
FIG. 1 provides a perspective view of a dryer appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
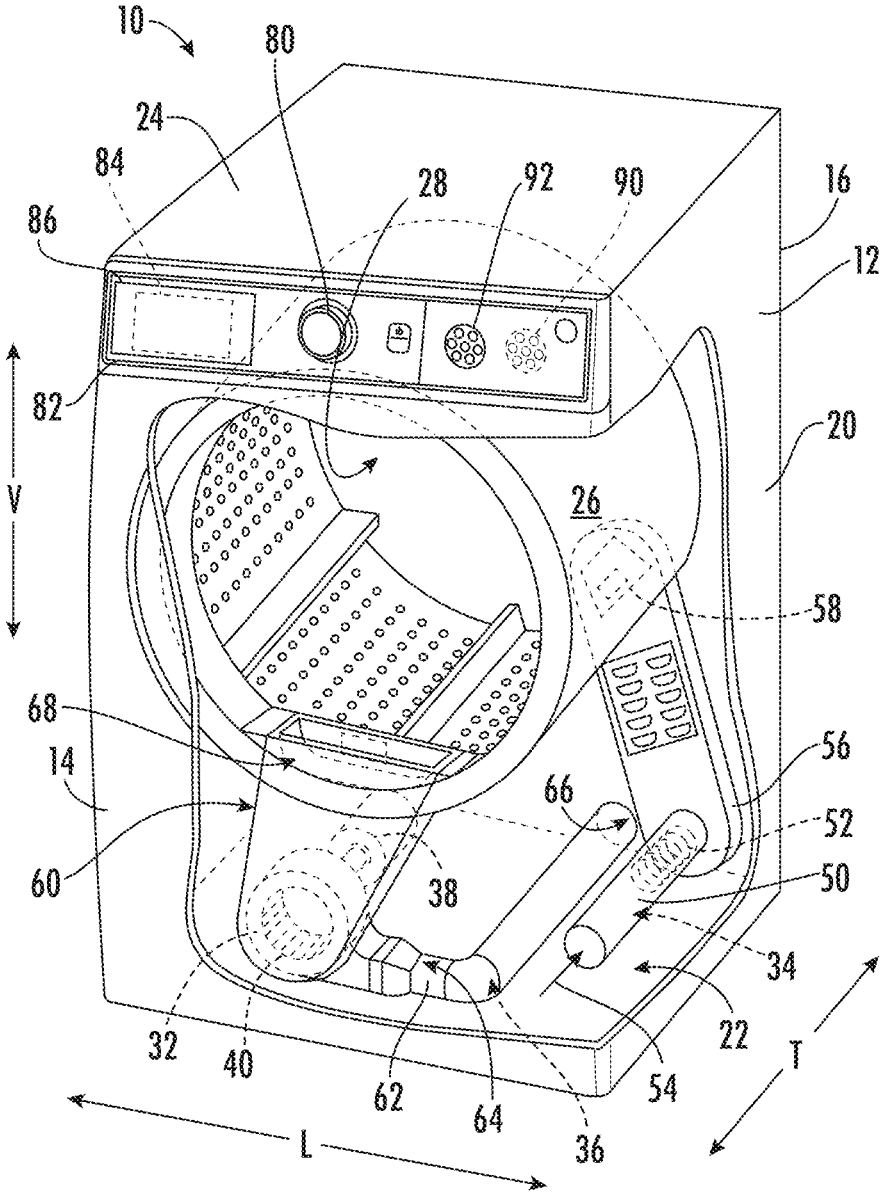
FIG. 2 provides a perspective view of the exemplary dryer appliance of FIG. 1 with portions of a cabinet of the exemplary dryer appliance removed to reveal certain components of the exemplary dryer appliance.

FIG. 1 illustrates a dryer appliance 10 according to an exemplary embodiment of the present subject matter. FIG. 2 provides another perspective view of dryer appliance 10 with a portion of a housing or cabinet 12 of dryer appliance 10 removed in order to show certain components of dryer appliance 10. While described in the context of a specific embodiment of a dryer appliance, using the teachings disclosed herein it will be understood that dryer appliance 10 is provided by way of example only. Other dryer appliances having different appearances and different features may also be utilized with the present subject matter as well.

Dryer appliance 10 defines a vertical direction V, a lateral direction L, and a transverse direction T. The vertical direction V, lateral direction L, and transverse direction T are mutually perpendicular and form an orthogonal direction system. Cabinet 12 includes a front panel 14 and a rear panel 16 spaced apart along the transverse direction T, a first side panel 18 and a second side panel 20 spaced apart along the lateral direction L, and a bottom panel 22 and a top cover 24 spaced apart along the vertical direction V. Within cabinet 12 is a container or drum 26 which defines a chamber 28 for receipt of articles, e.g., clothing, linen, etc., for drying. Drum 26 extends between a front portion and a back portion, e.g., along the transverse direction T. In example embodiments, drum 26 is rotatable, e.g., about an axis that is parallel to the transverse direction T, within cabinet 12. A door 30 is rotatably mounted to cabinet 12 for providing selective access to drum 26.

As best shown in FIG. 2, an air handler 32, such as a blower or fan, may be provided to motivate an airflow (not shown) through an entrance air passage 34 and an air exhaust passage 36. Specifically, air handler 32 may include a motor 38 which may be in mechanical communication with a blower fan 40, such that motor 38 rotates blower fan 40. Air handler 32 is configured for drawing air through chamber 28 of drum 26, e.g., in order to dry articles located therein, as discussed in greater detail below. In alternative example embodiments, dryer appliance 10 may include an additional motor (not shown) for rotating fan 40 of air handler 32 independently of drum 26.

Drum 26 may be configured to receive heated air that has been heated by a heating assembly 50, e.g., in order to dry damp articles disposed within chamber 28 of drum 26. Heating assembly 50 includes a heater 52 that is in thermal communication with chamber 28. For instance, heater 52 may include one or more electrical resistance heating elements or gas burners, for heating air being flowed to chamber 28. As discussed above, during operation of dryer appliance 10, motor 38 rotates fan 40 of air handler 32 such that air handler 32 draws air through chamber 28 of drum 26. In particular, ambient air enters an air entrance passage defined by heating assembly 50 via an entrance 54 due to air handler 32 urging such ambient air into entrance 54. Such ambient air is heated within heating assembly 50 and exits heating assembly 50 as heated air. Air handler 32 draws such heated air through an air entrance passage 34, including inlet duct 56, to drum 26. The heated air enters drum 26 through an outlet 58 of inlet duct 56 positioned at a rear wall of drum 26.

Within chamber 28, the heated air can remove moisture, e.g., from damp articles disposed within chamber 28. This internal air flows in turn from chamber 28 through an outlet assembly positioned within cabinet 12. The outlet assembly generally defines an air exhaust passage 36 and includes a trap duct 60, air handler 32, and an exhaust conduit 62. Exhaust conduit 62 is in fluid communication with trap duct 60 via air handler 32. More specifically, exhaust conduit 62 extends between an exhaust inlet 64 and an exhaust outlet 66. According to the illustrated embodiment, exhaust inlet 64 is positioned downstream of and fluidly coupled to air handler 32, and exhaust outlet 66 is defined in rear panel 16 of cabinet 12. During a dry cycle, internal air flows from chamber 28 through trap duct 60 to air handler 32, e.g., as an outlet flow portion of airflow. As shown, air further flows through air handler 32 and to exhaust conduit 62.

The internal air is exhausted from dryer appliance 10 via exhaust conduit 62. In some embodiments, an external duct (not shown) is provided in fluid communication with exhaust conduit 62. For instance, the external duct may be attached (e.g., directly or indirectly attached) to cabinet 12 at rear panel 16. Any suitable connector (e.g., collar, clamp, etc.) may join the external duct to exhaust conduit 62. In residential environments, the external duct may be in fluid communication with an outdoor environment (e.g., outside of a home or building in which dryer appliance 10 is installed). During a dry cycle, internal air may thus flow from exhaust conduit 62 and through the external duct before being exhausted to the outdoor environment.

In exemplary embodiments, trap duct 60 may include a filter portion 68 which includes a screen filter or other suitable device for removing lint and other particulates as internal air is drawn out of chamber 28. The internal air is drawn through filter portion 68 by air handler 32 before being passed through exhaust conduit 62. After the clothing articles have been dried (or a drying cycle is otherwise completed), the clothing articles are removed from drum 26, e.g., by accessing chamber 28 by opening door 30. The filter portion 68 may further be removable such that a user may collect and dispose of collected lint between drying cycles.

One or more selector inputs 80, such as knobs, buttons, touchscreen interfaces, etc., may be provided on a front control panel 82 and may be in communication with a processing device or controller 84. Signals generated in controller 84 operate motor 38, heating assembly 50, and other system components in response to the position of selector inputs 80. Additionally, a display 86, such as an indicator light or a screen, may be provided on front control panel 82. Display 86 may be in communication with controller 84 and may display information in response to signals from controller 84.

As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations. For certain embodiments, the instructions include a software package configured to operate appliance 10 and execute certain cycles or operating modes.

In some embodiments, dryer appliance 10 also includes one or more sensors that may be used to facilitate improved operation of dryer appliance. For example, dryer appliance 10 may include one or more temperature sensors which are generally operable to measure internal temperatures in dryer appliance 10 and/or one or more airflow sensors which are generally operable to detect the velocity of air (e.g., as an air flow rate in meters per second, or as a volumetric velocity in cubic meters per second) as it flows through the appliance 10. In some embodiments, controller 84 is configured to vary operation of heating assembly 50 based on one or more temperatures detected by the temperature sensors or air flow measurements from the airflow sensors.

Dryer appliance 10 may further include a microphone 90 that is used for monitoring the sound waves, noises, or other vibrations generated during the operation of dryer appliance 10. For example, microphone 90 may be one or more microphones, acoustic detection devices, vibration sensors, or any other suitable acoustic transducers that are positioned at one or more locations in or around dryer appliance 10. For example, according to exemplary embodiments, microphone 90 may be mounted within cabinet 12. In addition, or alternatively, microphone 90 may be positioned elsewhere within the room or residence where dryer appliance 10 is located. In this regard, any suitable microphone 90 that is acoustically coupled with dryer appliance 10 may be used to monitor sounds generated by dryer appliance 10.

According to an exemplary embodiment, microphone 90 may be configured for primarily monitoring sounds from within drum 26, chamber 28, and/or cabinet 12. In addition, dryer appliance 10 may further include an external microphone 92 that is positioned on or outside of cabinet 12 and is configured primarily for monitoring external sounds, e.g., those sounds not resulting from operation of dryer appliance 10. For example, external microphone 92 may be similar to microphone 90, but is positioned and oriented to monitor external noises. In order to more accurately monitor the sounds actually generated by dryer appliance, ambient noises picked up by external microphone 92 may be subtracted or removed from the sound signal picked up by microphone 90, thereby isolating actual dryer noises and associated operating conditions, as will be described in more detail below.

Notably, the sounds generated during operation of dryer appliance 10 may be associated with one or more operating conditions, failure modes, event occurrences, the presence of one or more distinct items within a load of clothes, etc. For example, if a user accidently leaves loose coins or a belt in a load of clothes, the noise of these items striking drum 26 may create a unique sound signature, identifiable for example by natural resonant frequencies, amplitudes, the time-based excitations, the excitation rate (e.g., the speed at which a particular sound is triggered), the time decay of the generated sound waves, or any other acoustic signature or characteristic. Similarly, the sounds generated by a load of clothes being tumbled in the drum 26 may create sounds from which various load characteristics may be determined, such as a dryness level, a load size, a load type, a cloth type, the presence of an air blockage or restriction, etc. For example, with respect to dryness level detection, as a load of heavy, wet clothes becomes drier, the weight of the load decreases and the tumbling impacts lesson. This results in a lower sound power compared to the beginning of the drying cycle. This difference can be monitored to determine the dryness level throughout the drying cycle to improve end of cycle targets. As explained in more detail below, aspects of the present subject matter are directed to systems and methods for monitoring sounds generated by an appliance, converting those sounds into a three-dimensional spectrogram, and using artificial intelligence image recognition processes to identify sounds signatures in the spectrogram.

In addition, referring again to FIG. 1, dryer appliance 10 may generally include an external communication system 100 which is configured for enabling the user to interact with dryer appliance 10 using a remote device 102. Specifically, according to an exemplary embodiment, external communication system 100 is configured for enabling communication between a user, an appliance, and a remote server 104. According to exemplary embodiments, dryer appliance 10 may communicate with a remote device 102 either directly (e.g., through a local area network (LAN), Wi-Fi, Bluetooth, etc.) or indirectly (e.g., via a network 106), as well as with a remote server, e.g., to receive notifications, provide confirmations, input operational data, transmit sound signals and sound signatures, etc.

In general, remote device 102 may be any suitable device for providing and/or receiving communications or commands from a user. In this regard, remote device 102 may include, for example, a personal phone, a tablet, a laptop computer, or another mobile device. In addition, or alternatively, communication between the appliance and the user may be achieved directly through an appliance control panel (e.g., control panel 160). In general, network 106 can be any type of communication network. For example, network 106 can include one or more of a wireless network, a wired network, a personal area network, a local area network, a wide area network, the internet, a cellular network, etc. In general, communication with network may use any of a variety of communication protocols (e.g., TCP/IP, HTTP, SMTP, FTP), encodings or formats (e.g. HTML, XML), and/or protection schemes (e.g., VPN, secure HTTP, SSL).

External communication system 100 is described herein according to an exemplary embodiment of the present subject matter. However, it should be appreciated that the exemplary functions and configurations of external communication system 100 provided herein are used only as examples to facilitate description of aspects of the present subject matter. System configurations may vary, other communication devices may be used to communicate directly or indirectly with one or more appliances, other communication protocols and steps may be implemented, etc. These variations and modifications are contemplated as within the scope of the present subject matter.

While described in the context of a specific embodiment of dryer appliance 10, using the teachings disclosed herein it will be understood that dryer appliance 10 is provided by way of example only. Other dryer appliances or laundry appliances having different configurations, different appearances, and/or different features may also be utilized with the present subject matter as well. Moreover, the systems and methods described herein may be used to monitor sounds generated by any other suitable appliance or appliances.

Now that the construction of dryer appliance 10 and the configuration of controller 84 according to exemplary embodiments have been presented, an exemplary method 200 of operating a dryer appliance will be described. Although the discussion below refers to the exemplary method 200 of operating dryer appliance 10, one skilled in the art will appreciate that the exemplary method 200 is applicable to the operation of a variety of other dryer appliances. In exemplary embodiments, the various method steps as disclosed herein may be performed by controller 84 or a separate, dedicated controller.

Figure 3:
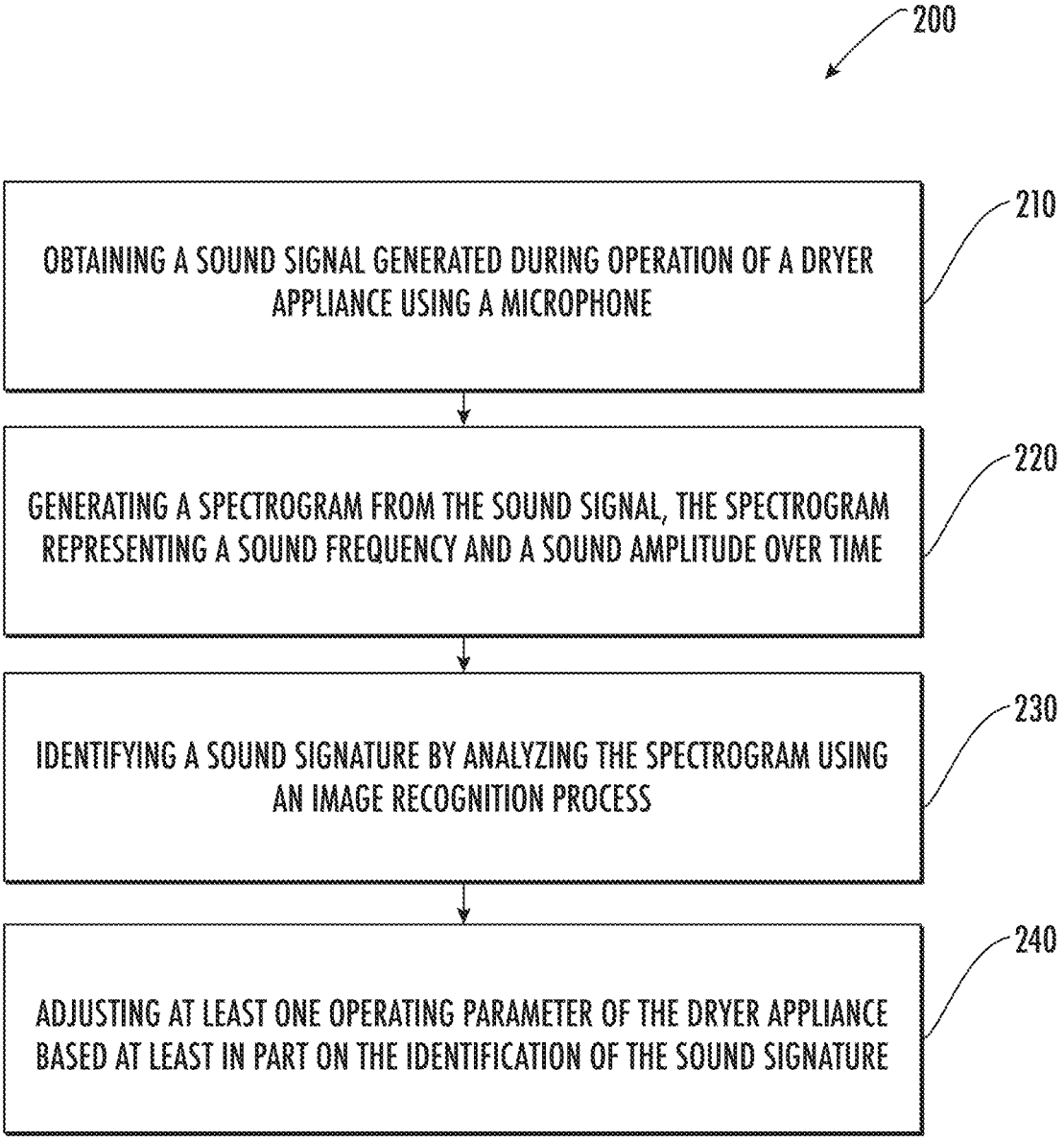
FIG. 3 illustrates a method for using sounds generated by a dryer appliance to identify operating conditions in accordance with one embodiment of the present disclosure.

Referring generally to FIG. 3, a method of operating a dryer appliance is provided. According to exemplary embodiments, method 200 includes, at step 210, obtaining a sound signal generated during operation of a dryer appliance using a microphone. For example, continuing the example from above, microphone 90 and/or external microphone 92 may be used to detect noises, sounds, vibrations, or other acoustic waves generated during the operation of dryer appliance 10. In addition, or alternatively, step 210 may include monitoring the sounds generated by dryer appliance 10 while it is not in operation, sounds generated during a diagnostic procedure, or any other suitable beeps, indicators, or sound waves that emanate from dryer appliance 10.

Step 220 includes generating a spectrogram from the sound signal. In this regard, for example, controller 84 may be configured for converting a sound clip or sound recording into a spectrogram for subsequent analysis. Thus, the original recording of sound from step 210 may be in the form of noise amplitude versus time, noise frequency versus time, noise amplitude versus noise frequency (e.g., a Fast Fourier transform or FFT), or any other suitable two-dimensional representation of the measured sound, such as the use of deep autoencoders with a 2-D bottleneck encoding. In addition, any suitable duration of sound may be measured at step 210 and converted at step 220. For example, according to exemplary embodiments, the sound signal is between about 0.1 seconds and 10 seconds, between about 1 in 5 seconds, or about 3 seconds.

Figure 4:
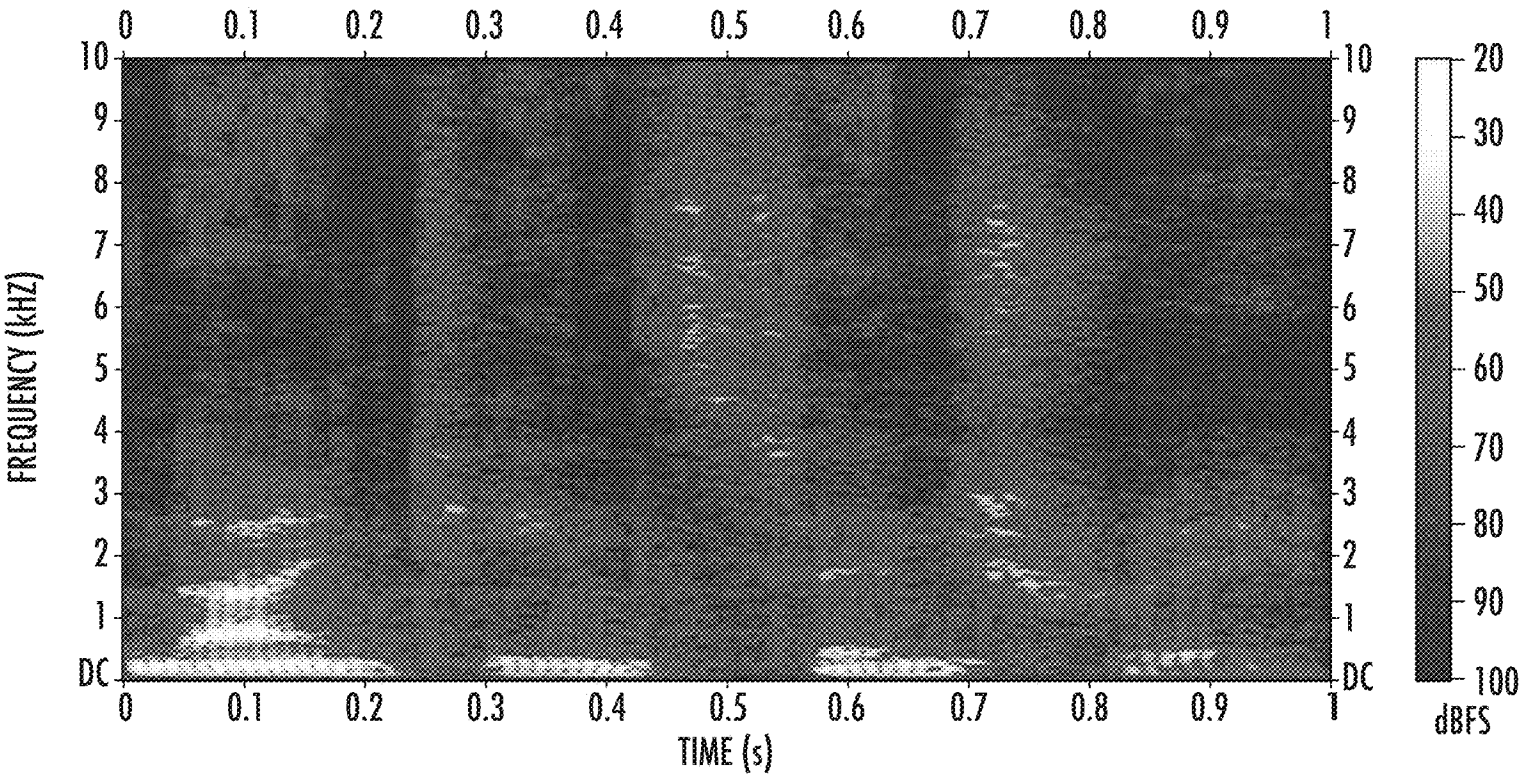
FIG. 4 provides an exemplary spectrogram according to an exemplary embodiment of the present subject matter.

Notably, the spectrogram generated at step 220 may be a three-dimensional representation of sound pressure or amplitude at a given frequency and time. Specifically, spectrograms may be a two-dimensional graphs, with a third dimension represented by colors. According to exemplary embodiments, the spectrogram represents both a sound frequency and a sound amplitude of over time. For example, such a spectrogram may be a visual representation of the spectrum of frequencies of a signal as it varies with time, sometimes referred to as waterfall diagrams. FIG. 4 provides an exemplary spectrogram that may be generated and analyzed according to aspects of the present subject matter. Notably, once the sound signal is converted to a spectrogram, controller 84 may use various image recognition processes or processing tools to identify noise sources and operating conditions, and may use such information for improving machine performance, e.g., by scheduling maintenance visits, adjusting operating parameters, providing user notifications, etc. In this regard, spectrogram images may add the element of time and may use color temperature to signal intensity or noise amplitude for improved knowledge of the appliance state or operation.

Step 230 includes identifying a sound signature by analyzing the spectrogram using an image recognition process. For example, image recognition processes that rely on artificial intelligence, neural networks, or any other suitable known image processing techniques may be used while remaining within the scope of the present subject matter. Specifically, using such a spectrogram image provides several advantages over existing sound recognition processes.

For example, the use of a spectrogram provides the potential to use a variety of sophisticated image recognitions models. According to an exemplary embodiment, portions of the image recognition processes may use single-label image convolution neural networks (CNNs) as the main algorithm to compare/classify spectrograms. As used herein, the terms image recognition and similar terms may be used generally to refer to any suitable method of observation, analysis, image decomposition, feature extraction, image classification, etc. of the spectrogram generated from sound signals measured from dryer appliance 10. It should be appreciated that any suitable image recognition software or process may be used to analyze the spectrograms and controller 84 may be programmed to perform such processes and take corrective action.

According to an exemplary embodiment, controller may implement a form of image recognition called convolutional neural network ("CNN") image recognition. Generally speaking, CNN may include taking an input image (e.g., a spectrogram) and using a convolutional neural network to identify unique signatures in the image, referred to herein generally as "sound signatures." According to still other embodiments, the image recognition process may use any other suitable neural network process. For example, the image recognition process may include the use of temporal convolutions ("T-CNN") and other types of deep feature extraction techniques. In addition, it should be appreciated that various sound preprocessing methods may be used, such as mel-frequency cepstrum coefficients ("MFCC"), or other suitable preprocessing techniques.

In addition, or alternatively, an Adam optimizer may be used, binary cross-entropy may be used as a loss function, and softmax as a last layer activation may be used. Any other suitable image classification technique may be used according to alternative embodiments. For example, various transfer techniques may be used, but use of such techniques is not required. If using transfer techniques learning, a neural network architecture may be pretrained such as VGG16/VGG19/ResNet50 with a public dataset then the last layer may be retrained with an appliance specific dataset.

In addition, or alternatively, the image recognition process may detect dryness or other events that depend on comparison of initial conditions. For example, a dry-initial spectrogram image may be subtracted from a spectrogram image while clothes are drying. The subtracted image may be used to train a neural network with two classes: dry, not dry. If not using any transfer learning VGG16 may be the neural net architecture of choice. In addition, or alternatively, two spectrogram images may be stacked, e.g., the dry initial spectrogram image from the spectrogram image on top and the spectrogram image while drying on the bottom of the image. In other words, according to exemplary embodiments, two images could be concatenated in any suitable manner and order. Moreover, according to alternative embodiments, two or more images could be combined by subtracting two spectrogram images or modifying such images in any other suitable manner. This combined image may be used in a similar way to train a neural network with two classes: dry, not dry. If detection of sound events does not require a comparison from the initial conditions, image combination may be avoided. To detect, for example, the dryer being ON, a wide variety of spectrograms recording of this event may be collected, label, and trained.

Figure 5:
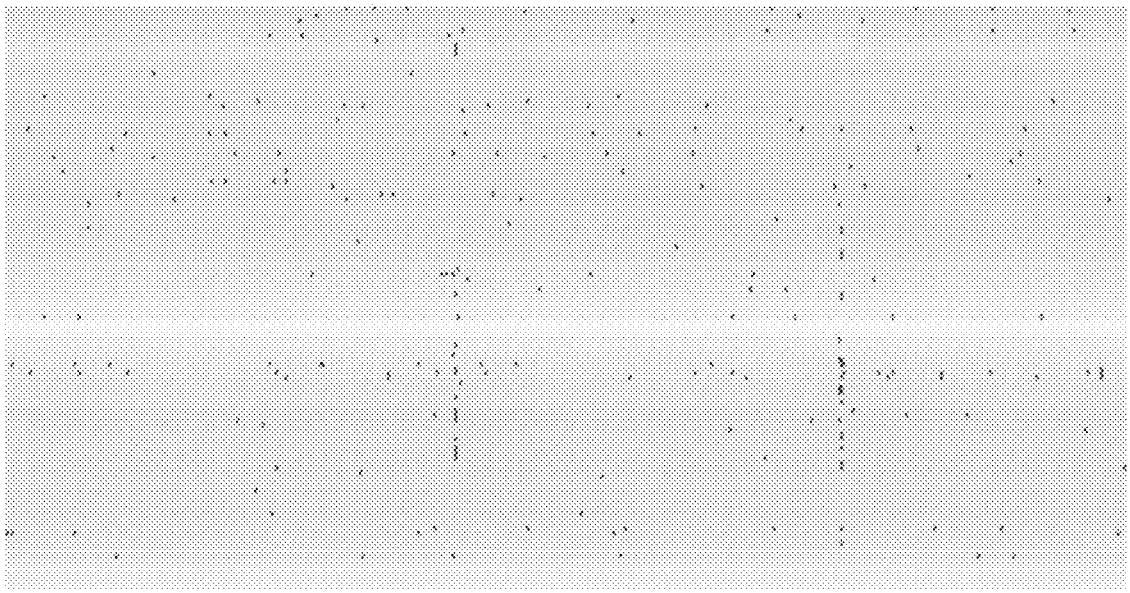
FIG. 5 provides an exemplary spectrogram of a dry load of clothes after subtracting out ambient noise according to an exemplary embodiment of the present subject matter.
Figure 6:
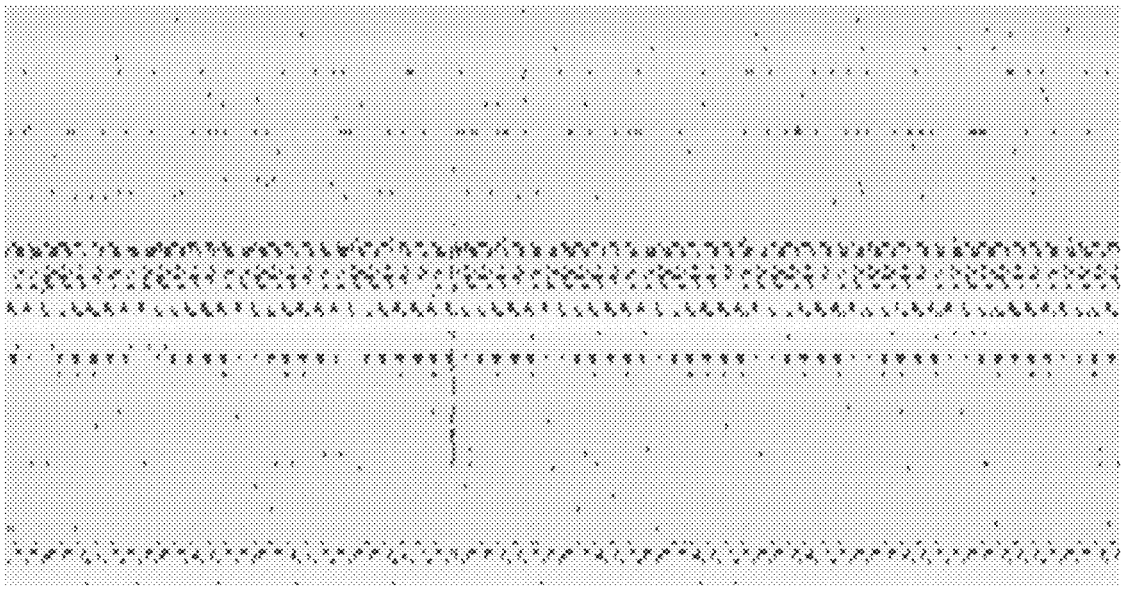
FIG. 6 provides an exemplary spectrogram of a wet load of clothes after subtracting out ambient noise according to an exemplary embodiment of the present subject matter.

Referring now briefly to FIGS. 5 and 6, exemplary spectrograms are provided of a load of dry clothes (FIG. 5) and a load of wet clothes (FIG. 6) after extracting or subtracting ambient noise. For example, as explained briefly above, microphone 90 may be positioned within cabinet 12, but may nonetheless pick up ambient noise, e.g., noise from another appliance, such as a washing machine appliance, noise generated by the user of the appliance, or other household or environmental sounds. In order to isolate sounds generated by dryer appliance 10, a spectrogram generated from the sound signal measured by external microphone 92 may be subtracted from a spectrogram generated from the sound signal measured by microphone 90, e.g., resulting in the compensated spectrograms illustrated in FIGS. 5 and 6. As a result, controller 84 may readily detect when a load of clothes is dry (i.e., when the spectrogram, compensated for external sound, looks similar to that shown in FIG. 5). It should be appreciated that subtracting the external noise provides numerous other benefits, such as better isolating particular operating conditions, mechanical failures, etc.

Notably, additional advantages of the use of spectrograms include privacy. For example, sound data collected as an image in inherently more private. In this regard, since the spectrogram contains no information about the exact, or even approximate, phase of the signal that it represents, the sound may be protected and may not be derivable from the spectrogram. For this reason, it may not be possible to reverse the process and generate a copy of the original signal from a spectrogram. In addition, a spectrogram image may allow for more effective memory use since it can be compressed. Notably, compressing the spectrogram may make it easier or less data intensive to transmit. Thus, for example, controller 84 may further be configured for transmitting the spectrogram (e.g., or the compressed spectrogram) to a remote server (e.g., such as remote server 104) for analysis. Controller 84 may further be configured for receiving analytic feedback from remote server 104. In this manner, data processing may be offloaded from controller 84.

Notably, controller 84 may further be configured for learning sound signatures associated with a dryer appliance 10. For example, common conditions or operating noises may be intentionally generated to train a neural network model. That model may then be used to detect particular sound signatures associated with particular events. Such sound signatures may be stored locally on controller 84 or a remote server 104. In addition, sound signatures may be appliance specific, may be stored according to a particular model or appliance configuration, or may be associated with a dryer appliance or another appliance in any other suitable manner.

Step 240 includes adjusting at least one operating parameter of the dryer appliance based at least in part on the identification of the sound signature. In this regard, if a sound signature associated with a specific condition is identified at step 230, controller 84 may take corrective action, e.g., by adjusting one or more operating parameters or implementing some other action in response to detecting that sound signature.

As used herein, an "operating parameter" of dryer appliance 10 is any cycle setting, operating time, component setting, spin speed, heat level, part configuration, or other operating characteristic that may affect the performance of dryer appliance 10. Thus, references to operating parameter adjustments or "adjusting at least one operating parameter" are intended to refer to control actions intended to improve system performance based on the sound signature or other system parameters. For example, adjusting an operating parameter may include adjusting a drum spin speed or profile, adjusting the cycle time, implementing a steam cycle, limiting a spin speed of drum 26, identifying service needs, providing a user with operating guidance, etc. Other operating parameter adjustments are possible and within the scope of the present subject matter.

In addition, according to exemplary embodiments, adjusting an operating parameter may include providing a user notification when the sound signature indicates that a predetermined operating condition exists. For example, according to one exemplary embodiment, the sound signature may be associated with sounds generated from one or more of a bearing, a belt, the motor 122, a water valve (e.g., for steam models), a pump, a suspension system, harmonics of structural components, undesirable contact between components or subsystems, etc. When a sound signature is generated that indicates a particular operating condition, e.g., such as a potential failure of one of these components, a user notification may be provided via display 86 or directly to a user's remote device 102 (e.g., a cell phone, via wireless connection).

FIG. 3 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using dryer appliance 10 as an example, it should be appreciated that these methods may be applied to the operation of any suitable dryer appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:
- a cabinet;
- a drum rotatably mounted within the cabinet, the drum defining a chamber for receipt of clothes for drying;
- a microphone for monitoring sound generated during operation of the dryer appliance; and
- a controller operably coupled to the microphone, the controller being configured to:
  - obtain a sound signal generated during operation of the dryer appliance using the microphone;
  - generate a spectrogram from the sound signal, the spectrogram representing a sound frequency and a sound amplitude over time;
  - identify a sound signature by analyzing the spectrogram using an image recognition process; and
  - adjust at least one operating parameter of the dryer appliance based at least in part on identification of the sound signature.

2. The dryer appliance of claim 1, wherein the image recognition process uses artificial intelligence (AI) to analyze the spectrogram.

3. The dryer appliance of claim 1, wherein the image recognition process comprises a convolution neural network (CNN).

4. The dryer appliance of claim 1, wherein the sound signature is associated with sounds generated from at least one of a bearing, a belt, a motor, a water valve, a suspension system, harmonics of structural components, or undesirable contact between components or subsystems.

5. The dryer appliance of claim 1, wherein the sound signature is associated with a load size, a load type, the presence of an air blockage, or a load dryness level.

6. The dryer appliance of claim 1, wherein adjusting the at least one operating parameter comprises:
- adjusting a drying time or profile, adjusting a heat level, identifying service needs, or providing a user with operating guidance.

7. The dryer appliance of claim 1, wherein adjusting the at least one operating parameter comprises:
- selecting an operating cycle based on the sound signature.

8. The dryer appliance of claim 1, wherein the controller is further configured for:
- providing a user notification when the sound signature indicates that a predetermined operating characteristic exists.

9. The dryer appliance of claim 1, wherein the sound signature is associated with the presence of an undesirable item, and wherein adjusting the at least one operating parameter comprises stopping the drying cycle.

10. The dryer appliance of claim 1, wherein the controller is further configured for:

learning a plurality of sound signatures associated with various operating conditions.

11. The dryer appliance of claim 1, wherein the controller is further configured for:

transmitting the spectrogram to a remote server for analysis; and receiving analytic feedback from the remote server.

12. The dryer appliance of claim 1, wherein the microphone is an internal microphone positioned on or within the cabinet, and wherein the dryer appliance further comprises:

an external microphone configured for monitoring external sound generated outside of the dryer appliance, the controller being configured to compensate for the external sound when identifying the sound signature.

13. The dryer appliance of claim 12, wherein the external microphone is positioned outside the cabinet and remote from the dryer appliance.

14. A method of operating a dryer appliance, the dryer appliance comprising a drum rotatably mounted within a cabinet, the drum defining a chamber for receipt of clothes for drying, and a microphone for monitoring sound generated during operation of the dryer appliance, the method comprising:

obtaining a sound signal generated during operation of the dryer appliance using the microphone;

generating a spectrogram from the sound signal, the spectrogram representing a sound frequency and a sound amplitude over time;

identifying a sound signature by analyzing the spectrogram using an image recognition process; and adjusting at least one operating parameter of the dryer appliance based at least in part on identification of the sound signature.

15. The method of claim 14, wherein the image recognition process uses artificial intelligence (AI) to analyze the spectrogram.

16. The method of claim 14, wherein the image recognition process comprises a convolution neural network (CNN).

17. The method of claim 14, wherein the sound signature is associated with a load size, a load type, the presence of an air blockage, or a load dryness level.

18. The method of claim 14, wherein adjusting the at least one operating parameter comprises:

selecting an operating cycle based on the sound signature.

19. The method of claim 14, wherein the sound signature is associated with the presence of an undesirable item, and wherein adjusting the at least one operating parameter comprises stopping the drying cycle.

20. The method of claim 14, wherein the microphone is an internal microphone positioned on or within the cabinet, and wherein the dryer appliance further comprises:

an external microphone configured for monitoring external sound generated outside of the dryer appliance, the controller being configured to compensate for the external sound when identifying the sound signature.

* * * * *